US005445425A

United States Patent [19]

Lyver

[11] Patent Number: 5,445,425

[45] Date of Patent: Aug. 29, 1995

[54] OFFSET HANDLE APPARATUS FOR PAINT BUCKETS

[76] Inventor: David J. Lyver, 18610 - 17th St. E., Sumner, Wash. 98390

[21] Appl. No.: 139,271

[22] Filed: Oct. 18, 1993

Related U.S. Application Data

[63] Continuation-in-part of Ser. No. 891,046, Jul. 10, 1992, abandoned.

[51] Int. Cl.[6] ..... B65D 25/32

[52] U.S. Cl. ..... 294/31.2; 220/762; 220/760

[58] Field of Search ..... 294/27.1, 31.2, 33, 294/68.26; 220/696, 762, 764, 758, 759, 760, 773; 16/114 R

[56] References Cited

U.S. PATENT DOCUMENTS

| | | | |
|---|---|---|---|
| 334,922 | 1/1886 | Alston | 294/31.2 |
| 627,273 | 6/1899 | Seibert | 220/762 |
| 1,180,354 | 4/1916 | White | 220/762 |
| 1,199,680 | 9/1916 | Fabian | 220/764 |
| 1,644,063 | 10/1927 | Kircher | 220/764 |
| 2,188,728 | 1/1940 | Spencer | 220/762 |
| 2,740,655 | 4/1956 | Maly | 294/31.2 |
| 2,789,002 | 4/1957 | Nicholas | 294/31.2 X |

FOREIGN PATENT DOCUMENTS

| | | | |
|---|---|---|---|
| 166967 | 11/1958 | France | 220/762 |
| 2482571 | 11/1981 | France | 294/68.26 |
| 819141 | 10/1951 | Germany | 220/762 |

*Primary Examiner*—Dean J. Kramer

[57] ABSTRACT

An offset handle and bracket assembly for mounting a handle offset from center on a paint bucket includes a handle adjustably attached to a pair of opposing brackets on a paint bucket. The handle pivots on a first pin inserted in a hole in the bracket adjoining another hole below. The pivoting adjustable handle is secured in a selective position, by positioning a second set pin on the handle in one of a plurality of set pin holes in the bracket. The set pin holes are spaced apart and adjoin a common arcuate slot allowing movement of the set pin among the set pin holes. These handle pins adjustably secured in matching holes wholely contained in the bracket support the bucket during lifting by handle while maintaining the handle in an orientation offset from vertical.

6 Claims, 2 Drawing Sheets

OFFSET HANDLE APPARATUS FOR PAINT BUCKETS

This is a continuation-in-part of Ser. No. 07/891,046, filed in the United States on Jul. 10, 1992 now abandoned.

BACKGROUND OF THE INVENTION

This invention relates to handles for buckets, pails, cans, etc. and particularly to an apparatus providing an adjustable handle offset from the bucket center for improved access to the bucket contents.

It is known in the art to have paint buckets or cans with bails attached diametrically opposed to bucket side fixtures such that in use the bucket hangs from the bail with the bail over the bucket center, largely restricting access of a paint brush to the bucket or can contents. To improve access to the bucket or can, a painter will often lean the bail to a bucket side and support the bucket with his fingers pushing the bucket away as the bucket tends to fall again under the bail center. This might continue until the user's fingers become tired or sore. Other similar makeshift approaches for providing improving access to the can contents can be attempted, usually ending with similar results—temporary at best and generally unsatisfactory for extended or repeated use.

It is also known in the art to have bucket bails that lift with the handle in a vertical orientation but rest off-vertical. However, it is not previously known to have a handle or bail that lifts a bucket while in an off-vertical orientation. Prior bucket or kettle bails return to a vertical orientation when lifted.

It is the object of this invention to provide a handle offset from the bucket center line, more comfortable to a user's hand than a conventional bail, from which a paint can or bucket can indefinitely hang safely, the handle extending away from the bucket a distance greater than a typical bail to facilitate improved access to the bucket contents with less obstruction from the handle.

It is a further object that the offset handle be adjustable. It is a another object that the handle be mountable to a paint bucket with or without a bucket bail. It is yet another object that the handle be mountable to a range of bucket sizes.

These objectives are obtained with the present invention by means of a bail apparatus mountable to a conventional paint can. The apparatus includes a handle adjustably secured in a selective off-vertical orientation from which the bucket hangs. Stability and leveraged advantage in supporting the bucket with the bucket hanging from the handle with the handle in an off-vertical orientation relative to the bucket is obtained through two handle pivot pins fitting into two matching closed bracket holes in each of two mounting brackets mounted in diametric opposition on the bucket to support the apparatus handle.

SUMMARY OF THE INVENTION

An offset handle and bracket apparatus for mounting an offset handle on a paint bucket is described that provides improved access to bucket contents. An adjustable handle adjustably attaches to a pair of brackets by a handle pivot pin and a handle set pin secured in a matching bracket pivot pin hole and one of a plurality of matching bracket set pin holes, each bracket receiving a handle arm and mounted on opposite sides of a bucket or paint can. In rest, or nonlifting mode, the handle pivots on the pivot pin in an oversized bracket hole to a selective orientation. The oversized bracket hole intersects the pivot pin hole thereby defining a key-hole configuration with the larger oversized hole under the smaller pivot pin hole. The pivoting adjustable handle is secured in the selective orientation by raising the set pin on the handle into one of the plurality of matching holes in the bracket as the pivot pin is raised from the oversized bracket hole into the pivot pin hole.

The set pin holes are spaced in an arc a common distance from the pivot point to facilitate later adjustment to a different position by displacement of the set pin out of a set pin hole and into a different set pin slot. Set pin movement between set pin holes is through an arcuate slot intersecting the set pin holes at its lower portion; a plurality of set pin holes open on its bottom but closed on its top are thus obtained.

With the offset handle and bracket apparatus mounted on a paint bucket, handle adjustment is thus obtained by lowering the set pin out of a set pin hole and into the arcuate slot as the pivot pin is lowered out of the pivot pin hole and into the oversized bracket hole. Handle reorientation is obtained by resetting the set pin into a different selective set pin hole.

In use, a paint can hangs from the bracket apparatus with the handle in an off-vertical orientation. Specifically, the two spaced-apart handle pins, the set pin and the pivot pin, lift in concert against the closed upper surface of the respective matching pin holes in the bracket, making the bucket stable in this orientation. In opposite, as in prior art, if the upper hole equivalent to the bracket set pin hole were open on its upper side, effectively forming a notch in the top of the bracket, upon lifting the handle the set pin would be displaced out of the hole causing the handle to move to the vertical. And if the handle were constrained to remain in the upper hole or notch by constraining the pivot pin to remain in the lower set pin hole, in the instant case the oversized bracket hole, then the system is only as stable as the constraint on the pivot pin in the lower hole and the advantage of lifting with both pins is also lost. The present invention eliminates the need for and the instabilities or weaknesses inherent in such a constraint by using the weight of the bucket to advantage in keeping the set pin in the selected set pin hole and the pivot pin in the matching pivot pin hole above the oversized bracket hole as the pins lift upward against the respective bracket surfaces circumscribing the pin holes.

The bracket apparatus is secured to the paint bucket with an adjustable belt which passes through slots in each bracket and around the can with the belt secured together in a traditional manner, such as hook and loop tape as in Velcro, or buckles or the like. The belt slots are positioned such that the belt is fitted on the can under the bucket top ridge so that the belt also provides support to the bucket as well as mounting the brackets. It can also be mounted to the bucket by placing a hole in each bracket over the bucket bail lugs mounted opposite each other on the bucket side. A slot is provided through which the bucket bail may pass. Upon placement of the bracket over the bail fixture, the bail is then sprung over the bracket lower portion providing a bias which urges the brackets against the bucket. The brackets have a groove on their inner side at the inner side top which fits over the paint bucket outside ridge at the bucket top, thus supporting the bucket at the bucket top ridge as well as by the bail fixture or by the mounting belt. The upper support is generally curved concave on its inner side to approximately match the curvature of the paint bucket.

DESCRIPTION OF THE PREFERRED EMBODIMENTS

Figure 1:
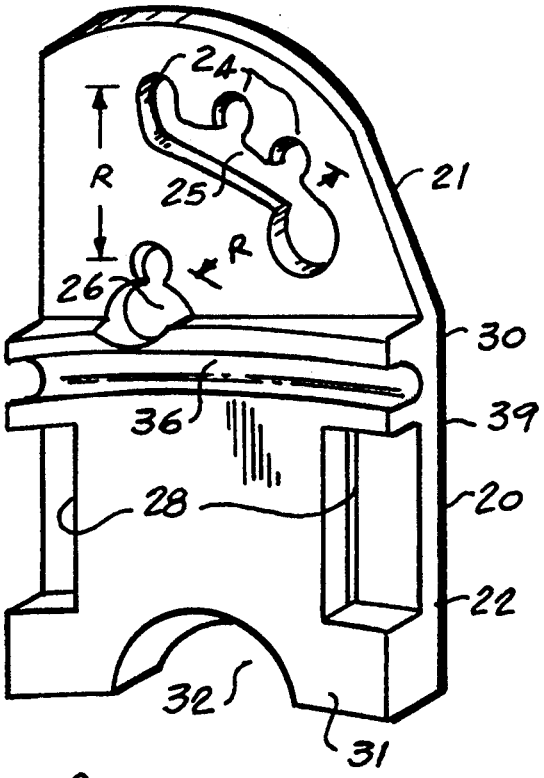
FIG. 1 is a perspective view of the inner side of a bracket.
Figure 1:
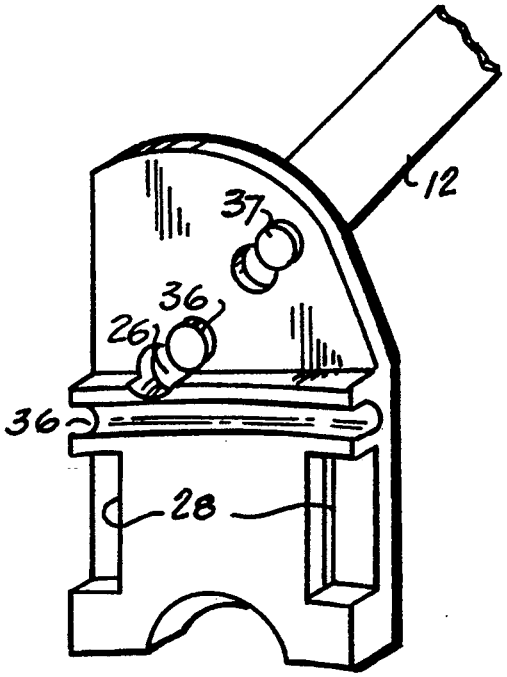
Figure 3:
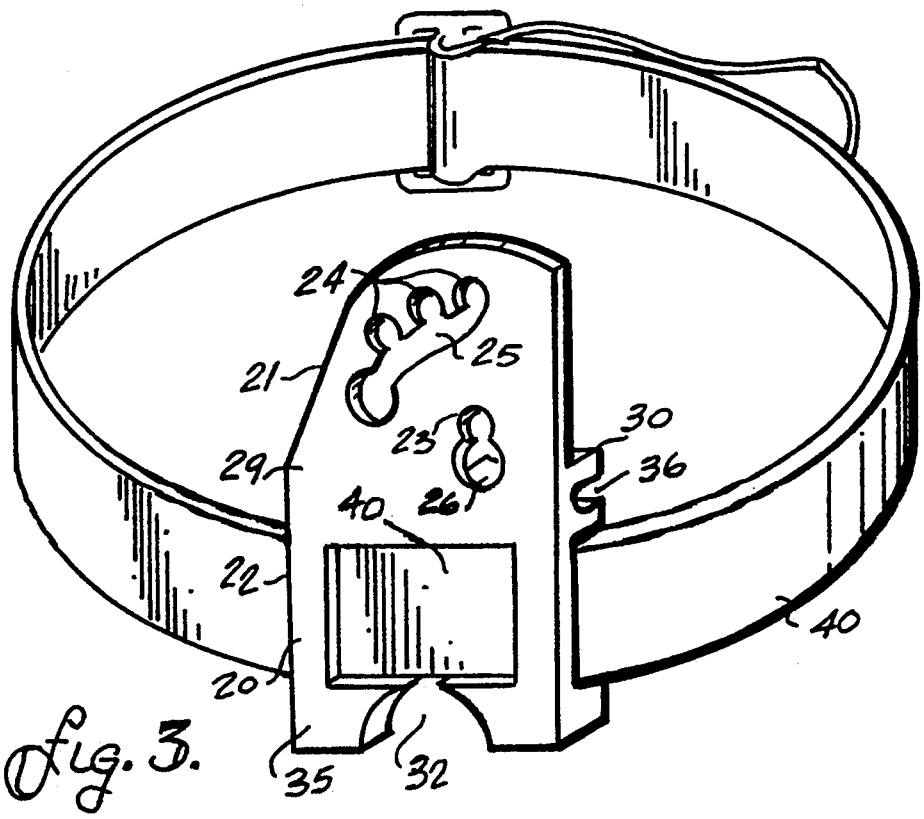
FIG. 3 is a perspective view of the outer side of the bracket together with a side view, showing a belt passing through the sides of the bracket and around the bracket outer side.
Figure 2:
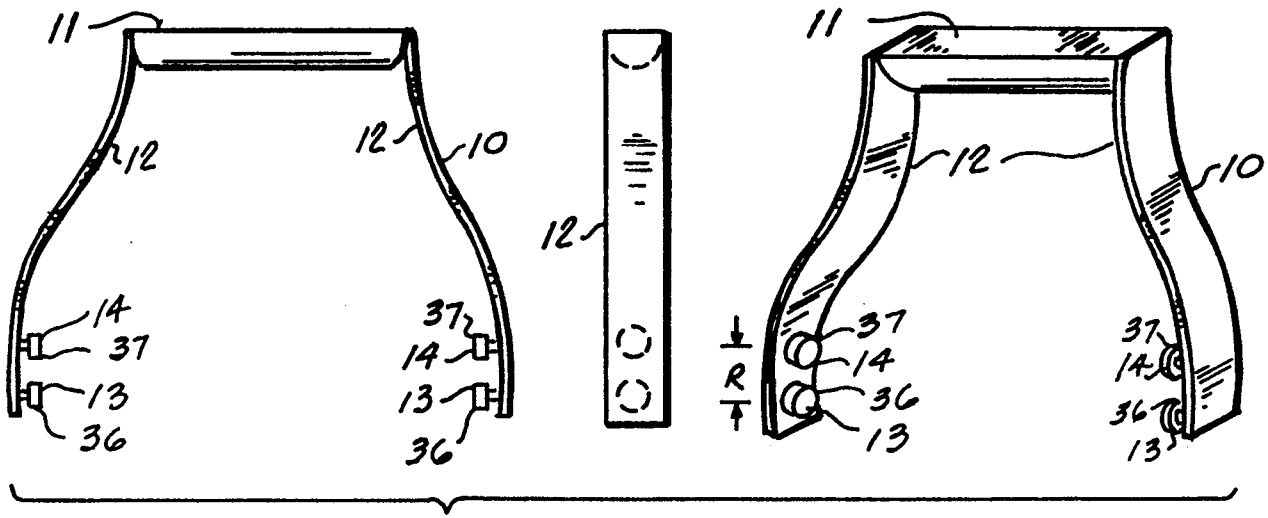
FIG. 2 is a perspective view of the adjustable handle together with side and end views of the handle.

Referring to the figures, the bracket apparatus for an offset paint bucket handle comprises principally an adjustable handle 10, a bracket 20, and a belt 40.

The adjustable handle 10 further comprises a handgrip member 11 molded to a pair of handle arms 12, one to each end of the handgrip member 11, and having on each handle arm end opposite the handgrip member 11 two pins protruding from the handle arm, a handle pivot pin 13 near the handle end and a set pin 14 a distance, R, toward the handgrip member 11 from the pivot pin 13.

The bracket 20 comprises a vertical plate 21 molded on the top of a bracket body 22. The vertical plate 21 has a pivot pin hole 23 and a plurality of set pin holes 24 arranged on an arc a distance, R, from the pivot pin hole 23 and matching in size the pivot pin 13 and the set pin 14, respectively. The vertical plate also has an arcuate slot 25 between the set pin holes 24 and the pivot pin hole 23 which extends in the vertical plate 21 to intersect the lower portion of set pin holes 24. Thus, the handle set pin 14 can pass from a set pin hole 24 into the arcuate slot 25 and selectively into any of the plurality of set pin holes 24. Also in the vertical plate 21 is an oversized bracket hole 26 intersecting the lower portion of the pivot pin hole 23 opposite the set pin hole 24. The intersection of the oversized bracket hole 26 and the pivot pin hole 23 forms a narrow passage 27 between them with the passage width equal to or slightly less than the pivot pin diameter such that the pivot pin 13 can pass through the passage 27 with slight frictional resistance sufficient to maintain the pivot pin 13 in the pivot pin hole 23 until urged out by a user.

It is apparent, then, that the removable handle is assembled into the bracket by placing the handle pivot pin 13 into the oversized bracket hole 26 and the set pin 14 into the arcuate slot 25 and then urging the two pins up into the pivot pin hole 23 and a selective set pin hole 24, respectively, of the bracket. With the handle pivot pin 13 secured in the pivot pin hole 23 and the handle 10 oriented to a selective position on the brackets with the handle set pin 13 removably placed securely in a set pin hole 23, further rotation of the handle in the bracket is prevented. Position of the handle in the bracket may be changed afterwards without removing the handle from the brackets by urging the pins 13 and 14 out of the respective pin hole 23 and hole 24 and repositioning the handle to a different pin hole selection.

The handle pivot pins 13 are secured in the respective bracket pivot pin holes 23 by enlarged heads 36 and 37 on the end of the pivot pin 13 and the set pin 14, respectively. The enlarged heads 36 and 37 are larger than the respective holes 23 and 24 but smaller than the oversized bracket hole 26 intersecting the pivot pin hole 23 and the arcuate slot 25, respectively. The pins 13 and 14 are sized in length to extend through the vertical plate 21. Thus, the handle 10 is securely attached to the bracket 20 by initially inserting the pivot pin 13 with enlarged head 36 through the oversized bracket hole 26 and the set pin 14 with enlarged head 37 through the arcuate slot 25 and then repositioning the pivot pin 13 into the pivot pin hole 23 and the set pin into a set pin hole 24.

Each bracket 20 also has a side slot 28 in each of the bracket body sides opening to its outer side 29. The bracket apparatus is securely mounted to a paint bucket by a belt 40 by positioning the brackets 20 opposite each other on a paint bucket 100 with the belt 40 entering through one side slot 28 at one side, passing to the bracket outer side 29 and reentering the bracket through the second side slot 28 and out the other bracket side and then wrapping around the paint bucket. The belt is secured to itself by any suitable method such as Velcro hook and loop tape, buckles, latches or the like.

The bracket apparatus also has a bucket support 30 with support groove 36 on the bracket body inner side 31 at the inner side top 39. When mounted on a paint can 101 or bucket 100, the bucket support 30 is positioned with the outside ridge 102 at the bucket top 103 in the support groove 36 to support the bucket 100 and maintain the bracket in its mounted position. The bucket support 30 is generally concave curved on its inner side 31 to approximately match the curvature of the paint bucket 100. To allow the belt 40 to also support the bucket along with the bucket support 30, the top of the slot 28 is approximately aligned vertically with the bucket support 30 such that the belt also fits under the paint bucket outside ridge. Further support and stability is provided with a channel 32 in the bottom side of the bracket body 20, sized to fit over a bucket bail lug 104.

In an alternative embodiment, the brackets are mounted to paint bucket 101 opposite each other by employing the can bail 105. Instead of a channel 32 in the bracket body 20, the bracket body 20 has a bail attachment hole 33 in the lower portion 35 of the bracket body 20. The bail attachment hole 33 is sized to fit over the bucket bail lug 104 with a bail slot 34 extending from the attachment hole 33 to a bracket body side 38 to allow a bucket bail 105 to pass through the bail slot 34. The bracket body 20 extends below the bucket bail lug 104. With the width of the lower bracket body 35 sized to receive the bucket bail 105 over the outer side 29 of the lower bracket body 35, the bucket bail 105 is urged over the lower bracket body 35 with the bail under stress producing a spring bias on the lower bracket body 35 which binds the bracket against the bucket.

Figure 6:
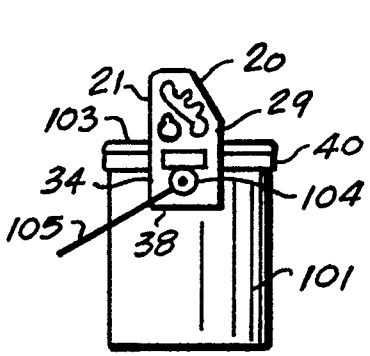
FIG. 6 shows a perspective view of the adjustable offset handle bracket apparatus secured to a paint can by the paint can bail.
Figure 7:
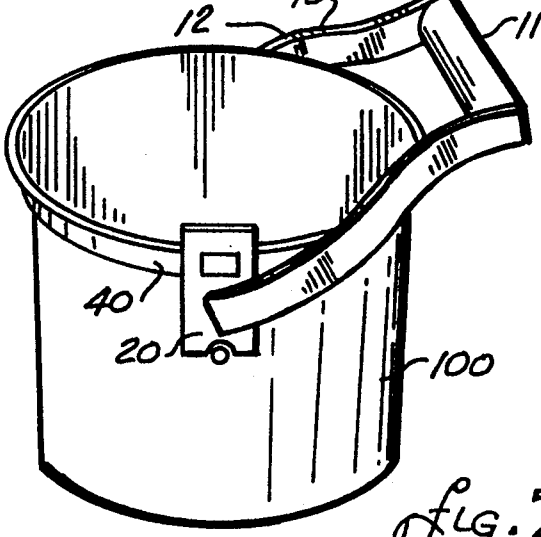
FIG. 7 is a perspective view of a handle secured to a bracket at a nonadjustable offset from bucket center.
Figure 5:
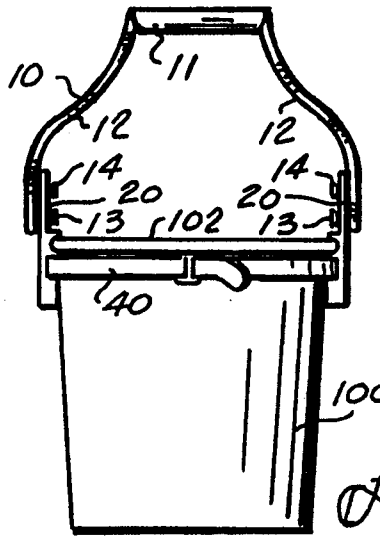
FIG. 5 shows a perspective view of the adjustable offset handle bracket apparatus secured to a paint bucket by a belt.
Figure 4:
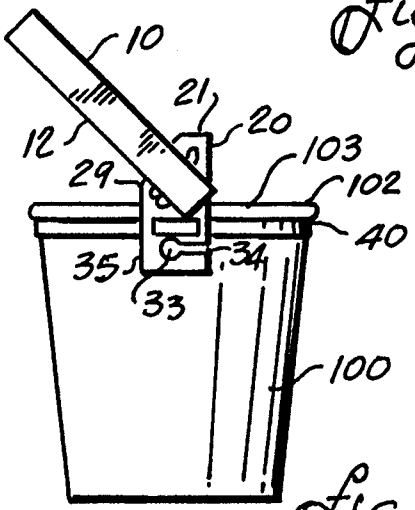
FIG. 4 is a side view of the adjustable offset handle apparatus showing the handle offset from the bucket center.

The preferred embodiment describes a handle that is adjustably offset from the center of a paint bucket. It is clear that a simplified alternative embodiment, shown in FIG. 6, is an offset handle that is not adjustable by reducing the plurality of set pin holes to a single hole, or equivalent means of securing a handle to a bracket. This and other obvious variations are intended to be included in the description of the invention.

Having described the invention, what is claimed is

1. An offset handle bracket apparatus for use on a paint bucket in securely maintaining a handle offset from vertical when the handle lifts the bucket thereby providing improved access to the bucket contents while the bucket is being lifted by the handle, comprising a handle including first and second ends and further comprising two pins extending from each handle end, the first pin being a handle pivot pin nearest the handle end and the second pin being a set pin spaced apart a distance, R, from the pivot pin, a pair of brackets each having a bracket body with an upper side, a bottom side, an outer side, an inner side, a left side and a right side, each bracket further having two holes wholly within the bracket body matching the two handle pins, respectively, of each handle for receiving a handle arm which remains securely offset from vertical when lifted when the bracket is mounted to a paint bucket such that when the bucket is lifted by the handle, the paint bucket hangs from the bracket apparatus while the handle is in an off-vertical orientation through the means of the two spaced-apart handle pins lifting upward in concert against bracket surfaces circumscribing the respective matching pin holes, means for securing the handle pins in the respective bracket pin holes, means for securely mounting the brackets opposite each other on a paint bucket.

2. The offset handle bracket apparatus of claim 1 wherein the handle is adjustably mounted to the bracket such that the handle can be reoriented and then maintained in a selective off-vertical orientation while the bracket apparatus lifts the bucket, comprising in the bracket body a plurality of set pin holes wholly within the bracket body on an arc a distance, R, from the pivot pin hole with the handle pivot pin rotatably secured in the pivot pin hole and the handle rotated to a selective position on the brackets with the handle set pin removably placed securely in a selective set pin hole such that further rotation of the handle in the bracket is prevented.

3. The offset handle bracket apparatus of claim 2 including means for changing the selective position of the handle in the brackets without removing the handle from the brackets, comprising in each bracket body, an arcuate slot intersecting the set pin holes at a lower hole portion thereby forming a plurality of set pin holes each closed on its top to maintain a bracket circumscribing hole surface against which the handle pins are lifted but open on its bottom such that the handle set pin can pass from a set pin hole into the arcuate slot and from the arcuate slot into any one of the plurality of set pin holes, and also in the bracket body, an oversized bracket hole intersecting a lower portion of the pivot pin hole opposite the set pin holes to allow downward displacement of the pivot pin from its lift position in the pivot hole as the set pin is lowered downward from its lift position in a pivot pin hole and into the arcuate slot for reorientation of the handle.

4. The bracket apparatus of claim 1 further comprising a bucket support on the bracket body inner side at the inner side top having a groove for receiving a bucket outside ridge, the bracket apparatus thereby supporting the bucket from the bucket outside ridge.

5. The combination of the offset handle bracket apparatus of claim 1 and a paint can having a bail and two diametrically opposed bail lugs extending from the bucket to which the bail is attached, wherein the means for securely mounting the brackets opposite each other on a paint bucket comprises a bail lug hole in the lower portion of the bracket body sized to fit over a bucket bail lug with a bail slot extending from the attachment hole to a bracket body side to allow a bucket bail to pass through the bail slot, the bracket body extending below the bucket bail lug and sized to receive the bucket bail over the outer side of the lower bracket body with the bail binding the bracket against the bucket.

6. An offset handle bracket apparatus for use on a paint bucket in securely maintaining a handle offset from vertical when the handle lifts the bucket thereby providing improved access to the bucket contents while the bucket is being lifted by the handle, comprising a handle including first and second ends and further comprising two pins extending from each handle end, the first pin being a handle pivot pin nearest the handle end and the second pin being a set pin spaced apart a distance, R, from the pivot pin, a pair of brackets each having a bracket body with an upper side, a bottom side, an outer side, an inner side, a left side and a right side, each bracket further having two holes wholely within the bracket body matching the two handle pins, respectively, of each handle for receiving a handle arm which remains securely offset from vertical when lifted when the bracket is mounted to a paint bucket such that when the bucket is lifted by the handle, the paint can hangs from the bracket apparatus while the handle is in an off-vertical orientation through the means of the two spaced-apart handle pins lifting upward in concert against bracket surfaces circumscribing the respective matching pin holes, for securing the handle pivot pins in the respective bracket pivot pin holes, an enlarged head on the end of the pivot pin or the set pin, or both, said pin or pins sized in length to extend through the bracket body, the enlarged head being larger than the corresponding pivot pin hole or set pin hole but smaller than the oversized bracket hole intersecting the pivot pin hole or arcuate slot, respectively, such that the handle can be securely attached to the bracket by initially inserting the said pin with enlarged head through the oversized bracket hole or the arcuate slot, respectively, and then repositioning said pin or pins into the corresponding pin hole or holes, means for securely mounting the brackets opposite each other on a paint bucket.

* * * * *